US007209130B2

(12) United States Patent
Tsujino et al.

(10) Patent No.: US 7,209,130 B2
(45) Date of Patent: Apr. 24, 2007

(54) LEVEL SHIFTER AND DISPLAY DEVICE USING SAME

(75) Inventors: Sachio Tsujino, Matsusaka (JP); Hoh Riku, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/941,912

(22) Filed: Sep. 16, 2004

(65) Prior Publication Data

US 2005/0078100 A1 Apr. 14, 2005

(30) Foreign Application Priority Data

Sep. 19, 2003 (JP) ..... 2003-328614

(51) Int. Cl.
*G09G 5/00* (2006.01)
*G09G 3/10* (2006.01)

(52) U.S. Cl. ..... 345/204; 315/169.2

(58) Field of Classification Search ..... 315/169.3, 315/169.4, 169.2; 345/100, 99, 98, 204
See application file for complete search history.

(56) References Cited

U.S. PATENT DOCUMENTS 5,041,823 A * 8/1991 Johnson et al. ..... 345/94
6,091,392 A * 7/2000 Imamura ..... 345/100
6,724,363 B1 * 4/2004 Satoh et al. ..... 345/100
6,836,269 B2 * 12/2004 Maeda et al. ..... 345/212
6,920,570 B2 * 7/2005 Fujimoto et al. ..... 713/300
6,970,153 B2 * 11/2005 Park ..... 345/102
2003/0179174 A1 9/2003 Matsuda et al. ..... 345/100
2004/0108989 A1 6/2004 Gyouten et al. ..... 345/100

OTHER PUBLICATIONS

Copending U.S. Appl. No. 10/788,161, filed Feb. 25, 2004.

* cited by examiner

*Primary Examiner*—Shih-Chao Chen
*Assistant Examiner*—Minh Dieu A
(74) *Attorney, Agent, or Firm*—Nixon & Vanderhye P.C.

(57) ABSTRACT

A level-shifter is combined with a bi-directional shift register. The level shifter turns a start signal of the bi-directional shift register to be an enable signal, and (i) activates a level shifting section by supplying a stationary current, during a period in which the enable signal is HIGH, while (ii) deactivates the level shifting section by cutting off the stationary current, during a period in which the enable signal EN is LOW. With this, it is possible to reduce unnecessary current consumption by a level shifter provided for a signal which does not frequently change, such as a shifting direction switching signal for which the bi-directional shift register is provided. At the same time, when such a signal changes, the change is followed with no time lag.

9 Claims, 11 Drawing Sheets

21

LEVEL SHIFTER AND DISPLAY DEVICE USING SAME

This Nonprovisional application claims priority under 35 U.S.C. § 119(a) on Patent Application No. 2003/328614 filed in Japan on Sep. 19, 2003, the entire contents of which are hereby incorporated by reference.

FIELD OF THE INVENTION

The present invention relates to a level shifter suitably used for a scanning signal line drive circuit and a data signal line drive circuit of a matrix display device, and particularly to the level shifter and a scanning signal line drive circuit, a data signal line drive circuit, and a display device which adopt the level shifter.

BACKGROUND OF THE INVENTION

In a scanning signal line drive circuit and a data signal line drive circuit of a matrix display device, shift registers are widely adopted to generate a scanning signal supplied to scanning signal lines and to control the timings for sampling voltages, which are supplied to respective data signal lines, from a video signal.

Meanwhile, being typified by a monitor panel of a video camera and a digital camera, a device, which can reproduce a mirror image which is a display image being inversed left to right or upside down in accordance with the orientation of an image display section, has been in practical use. In such a display device which can invert a display image, a bi-directional shift register which can switch the shifting direction (scanning direction) of data is used. With this bi-directional shift register, a mirror image can be reproduced only by switching the shifting direction, without storing a video signal.

For the meantime, the power consumption of an electronic circuit typified by an IC increases in proportion to the frequency, load-carrying capacity, and the second power of the voltage. For this reason, with regard to peripheral devices connected to the display device, such as a circuit generating a video signal supplied to the display device, and also with regard to the display device itself, there are increasing tendencies to further lower the drive voltages in order to reduce the power consumption.

Incidentally, there is a monolithic display device in which not only circuits of the display section but also a scanning signal line drive circuit and a data signal line drive circuit for driving the display section are formed on a substrate on which the display section is formed, in order to narrow down the frame circumscribing the display section and enlarge the size of the display section.

However, in the monolithic display device, particularly in a display device in which the scanning signal line drive circuit and the data signal line drive circuit are made up of polycrystalline silicon thin-film transistors, the difference between threshold voltages sometimes reaches several volts between the substrate or in one substrate. Thus, there is still a room for the reduction of the drive voltage.

For this reason, the scanning signal line drive circuit and the data signal line drive circuit driving the display section do not operate with a low-voltage signal supplied from the peripheral circuits which are driven by the low drive voltage, so that a level shifter which steps up the low-voltage signal to the operation voltage of these drive circuits is required.

FIG. 11 shows typical circuitry of such a level shifter. A level shifter 900 in the figure includes PMOS transistors 901, 903, 905, and 907 and NMOS transistors 902, 904, 906, and 908.

The PMOS transistors 901 and 903 are arranged such that the gate terminals are connected to a VSS level, the source terminals are connected to a VDD level, and the drain terminals are connected to the respective drain terminals of the NMOS transistors 902 and 904. The gate terminal and the drain terminal of the NMOS transistor 902 are connected to each other, and the source terminal of the NMOS transistor 902 is connected to the VSS level. The source terminal of the NMOS transistor 904 receives an input signal in (which is the target of stepping up). The PMOS transistors 901 and 903 and the NMOS transistors 902 and 904 constitute a level shifting section (level shifting means) 912.

The gate terminals of the PMOS transistor 905 and the NMOS transistor 906 are connected with a junction V2 of the drain terminal of the PMOS transistor 903 and the drain terminal of the NMOS transistor 904. The drain terminals of the PMOS transistor 905 and the NMOS transistor 906 are connected to each other. The source terminal of the PMOS transistor is connected to the VDD level, while the source terminal of the NMOS transistor 906 is connected to the VSS level. The PMOS transistor 905 and the NMOS transistor 906 constitute an inverter 910.

The junction of the drain terminal of the PMOS transistor 905 and the drain terminal of the NMOS transistor 906 functions as an output terminal of the inverter 910, and this output terminal is connected to the gate terminals of the PMOS transistor 907 and the NMOS transistor 908. The drain terminals of the PMOS transistor 907 and the NMOS transistor 908 are connected to each other. The source terminal of the PMOS transistor 907 is connected to the VDD level, while the source terminal of the NMOS transistor 908 is connected to the VSS level. The PMOS transistor 907 and the NMOS transistor 908 constitute an inverter 911 of the second stage. The junction of the drain terminal of the PMOS transistor 907 and the drain terminal of the NMOS transistor 908 function as an output terminal of the inverter 911, and an output signal out is outputted from this output terminal.

In the above-described level shifter, the gate terminal of the PMOS transistor 901 is connected to the VSS level, so that the PMOS transistor 901 turns ON and the VDD level appears at the drain terminal of the PMOS transistor 901. Since this drain terminal is also connected to the gate terminal of the NMOS transistor 902, the NMOS transistor 902 also turns ON. As a result, the junction V1 of the PMOS transistor 901 and the NMOS transistor 902 has a constant voltage between the VDD level and the VSS level, and this constant voltage is used as a bias voltage of the NMOS transistor 904.

The PMOS transistor 903 turns ON as the gate terminal thereof is connected to the VSS level, and the drain terminal of the PMOS transistor 903 is at the VDD level. The NMOS transistor 904 also turns ON as the gate terminal thereof receives the bias voltage appearing at the junction V1. As a result, a voltage at the output terminal V2 of the level shifting section 912, the output terminal V2 being identical with the junction V2 of the PMOS transistor 903 and the NMOS transistor 904, is determined by a voltage of the input signal in supplied from the input terminal. Assuming that the input signal in at the VSS level is LOW and the input signal in at the VCC level (VCC<VDD) is HIGH, the junction V2 is at a constant voltage Vlow which is between the VDD and VSS levels, when the input signal in is LOW, while the junction V2 is at a constant voltage Vhigh which is between the VDD and VCC levels, when the input signal in is HIGH.

The inverter 910 made up of the PMOS transistor 905 and the NMOS transistor 906 has a threshold between the voltages Vlow and Vhigh. When the voltage at the junction V2, which is supplied to the inverter 910, is Vlow, the PMOS transistor 905 turns ON so that the junction V3 equivalent to the output terminal of the PMOS transistor 905 is at the VDD level. In the meantime, when the voltage at the junction V2 is Vhigh, the NMOS transistor 906 turns ON so that the junction V3 is at the VSS level.

The inverter 911 made up of the PMOS transistor 907 and the NMOS transistor 908 is a conventional inverter. When the voltage at the junction V3, which is supplied to the inverter 911, is at the VDD level, the NMOS transistor 908 turns ON so that the output signal out therefrom is at the VSS level. Meanwhile, when the junction V3 is at the VSS level, the PMOS transistor 907 turns ON so that the output signal out therefrom is at the VDD level.

In summary, when the input signal in supplied to the level shifting section 912 is LOW (VSS level), the high-voltage output signal out is at the VSS level. When the low-voltage input signal in is HIGH (VCC level), the high-voltage output signal out is at the VDD level. In this manner, the low-voltage input signal in is level-shifted to the high-voltage output signal out.

Incidentally, in the foregoing level shifter 900, there is a current path from a VDD-level power source on the HIGH side to a VSS-level power source on the LOW side, and a current termed a stationary current always flows in the current path. More specifically, the stationary current flows from the PMOS transistor 901 to the NMOS transistor 902, thereby causing the junction V1 to have a predetermined voltage, and generating the bias voltage of the NMOS transistor 904. As a result, the level shifting section 912 operates. However, although such a stationary current is required for level-shifting the low-voltage input signal in to the high-voltage output signal out, the stationary current unnecessarily flows even when the level shifting is not carried out, thereby unnecessarily increasing the power consumption.

To reduce the unnecessary power consumption in the shift register, Japanese Laid-Open Patent Application No. 2000-322020 (Tokukai 2000-322020; published on Nov. 24, 2000) teaches as follows: Among level shifters which step up a start signal and are provided at the respective sides of a bi-directional shift register, one of these level shifters which does not correspond to the present shifting direction is not used, so that the path of a stationary current in that level shifter not being used is blocked.

In a panel adopting a bi-directional shift register which can switch the shifting direction, a start signal which starts the bi-directional shift register has to be supplied from one of two sides of the bi-directional shift register. For this reason, level shifters for level-shifting the start signal may be provided on the both sides of the bi-directional shift register. However, the shift direction is not frequently switched, and hence one of the level shifters is kept unused until the shift direction is changed. The Japanese document teaches the elimination of unnecessary power consumption in that unused level shifter.

Prior to the present application, the applicant of the present invention proposed a structure which can reduce the power consumption more than the above-described Japanese Laid-Open Patent Application No. 2000-322020, by eliminating the stationary current flowing in the level shifter which level-shifts the start signal, during the operating time of that shift register (Japanese Patent Application No. 2003-3284; applied on Jan. 9, 2004, corresponding to US2003/0179174A1; published in U.S.A. on Sep. 25, 2003).

This patent application found that, in Japanese Laid-Open Patent Application No. 2000-322020, the stationary current always flows in the level shifter being used and this current also results in unnecessary power consumption.

That is to say, the start signal requires the level shifting only when being switched from LOW to HIGH or HIGH to LOW, i.e. only when the bi-directional shift register starts. Therefore, the level shifting is unnecessary except these occasions. In other words, during the operating time of the bi-directional shift register, the level shifter which level-shifts the start signal is not required to operate, so that the stationary current of this shift register is not required. On this account, the power consumption is reduced in such a manner that the stationary current of the level shifter which level-shifts the start signal is eliminated during the operating time of the shift register.

Incidentally, when the start signal of the bi-directional shift register has a low voltage, a shifting direction switching signal which switches the shifting direction of the bi-directional shift register generally has a low voltage as well. For this reason, a level shifter for stepping up the shifting direction switching signal is provided as a matter of course. Therefore, unnecessary power consumption due to the above-described stationary current also occurs in this level shifter for the shifting direction switching signal.

In this behalf, the above-mentioned Japanese Laid-Open Patent Application No. 2000-322020 and US2003/0179174A1 both intend to reduce the power consumption in the level shifter which steps up the start signal, and hence neither of these documents mentions the reduction of the power consumption in the level shifter which steps up the shifting direction switching signal.

Furthermore, on the occasion of switching the shifting direction of the bi-directional shift register, it is necessary to change the shifting direction switching signal after the shifting in the bi-directional shift register finishes and before a start signal is newly supplied to the bi-directional shift register. This is because, if the shifting direction switching signal is changed during the signal shifting in the bi-directional shift register, the shifting direction is switched in the midst of the shifting operation, so that an image may not be properly reproduced.

To supply the shifting direction switching signal to the bi-directional shift register at a right timing, it is necessary to configure the logic in such a manner as to cause the shifting direction switching signal to be supplied after the signal shifting operation in the bi-directional shift register finishes and before the input of the next start signal, no matter when the shifting direction switching signal is changed.

The above-described problem of unnecessary power consumption in the level shifter for the shifting direction switching signal occurs not only in the level shifter for the shifting direction switching signal but also in level shifters for signals which are not frequently changed as in the case of the shifting direction, such as a resolution switching signal for switching resolutions and a driver switching signal for switching between a binary driver and an analog driver.

SUMMARY OF THE INVENTION

The objective of the present invention is to provide (a) a level shifter for a signal which does not frequently change, such as a shifting direction switching signal of a bi-directional shift register, the level shifter being arranged such that, fewer amounts of power is consumed as unnecessary current consumption is reduced, while, when the signal changes, the change is followed with no time lag, and (b) a scanning signal line drive circuit, a data signal line drive circuit, and a display device which adopt the level shifter (a).

To achieve this objective, the level shifter of the present invention is combined with a shift register and includes a level shifting section in which a stationary current flows, the level shifting section for causing a signal level of an input signal to level-shift, a frequency of the input signal being lower than a frequency of a start signal for starting the shift register, the level shifter comprising: an operation control section for, by means of the start signal, (i) activating the level shifting section by supplying the stationary current to the level shifting section, during a period in which the start signal is on an active level, while (ii) deactivating the level shifting section by cutting off the stationary current, during a period in which the start signal is on a non-active level.

According to this arrangement, thanks to the operation of the operation control section, the stationary current flows in the level shifting section only during the period in which the start signal is on the active level, while the stationary current is cut off during the period in which the start signal is on the non-active level. On this account, the power consumption is reduced compared to the arrangement in which the stationary current always flows.

Moreover, since the level shifting section is activated only in the period in which the start signal of the shift register is on the active level, the timing at which the input signal is -level-shifted in the level shifting section does not overlap the shifting operation period of the shift register. For this reason, even if the input signal is changed in the midst of the shifting operation of the shift register, the level-shifting of the input signal and the change of the operation (reflection of the signal change to the operation) always occur during a period in which the shifting operation of the shift register is not performed. For this reason, it is unnecessary to take any measures to prevent the operation change due to the change of the input signal from being performed during a period in which the shifting operation of the shift register is performed.

Furthermore, the operation change due to the change of the input signal occurs in the next shifting operation period of the shift register, after the period in which the change of the input signal occurs. For this reason, when the input signal changes, it is possible to cause the operation to follow the change with no time lag.

To achieve the objective above, the scanning signal line drive circuit of the present invention which includes a shift register and drives scanning signal lines, comprises (a) level shifting section in which a stationary current flows and (b) a level shifter for level-shifting a signal level of an input signal in the level shifting section, the level shifter being provided on an input of the shift register, a frequency of the input signal being lower than a frequency of a start signal for starting the shift register, and the level shifter including operation control section for, by means of the start signal, (i) activating the level shifting section by supplying the stationary current to the level shifting section, during a period in which the start signal is on an active level, while (ii) deactivating the level shifting section by cutting off the stationary current, during a period in which the start signal is on a non-active level.

To achieve the objective above, the data signal line drive circuit of the present invention, which includes a shift register and drives data signal lines, comprises (a) level shifting section in which a stationary current flows and (b) a level shifter for level-shifting a signal level of an input signal in the level shifting section, the level shifter being provided on an input of the shift register, a frequency of the input signal being lower than a frequency of a start signal for starting the shift register, and the level shifter including operation control section for, by means of the start signal, (i) activating the level shifting section by supplying the stationary current to the level shifting section, during a period in which the start signal is on an active level, while (ii) deactivating the level shifting section by cutting off the stationary current, during a period in which the start signal is on a non-active level.

To achieve the objective above, the display device of the present invention includes: a scanning signal line drive circuit provided with a shift register; and a data signal line drive circuit provided with a shift register, an image being displayed on the display device in such a manner that, into display sections circumscribed by scanning signal lines and data signal lines intersected with each other, the scanning signal line drive circuit and the data signal line drive circuit write a video signal by driving the scanning signal lines and the data signal lines, at least one of the scanning signal line drive circuit and the data signal line drive circuit including a level shifter which is combined with the shift register and includes level shifting section in which a stationary current flows, the level shifting section for causing a signal level of an input signal to level-shift, a frequency of the input signal being lower than a frequency of a start signal for starting the shift register, the level shifter including: operation control section for, by means of the start signal, (i) activating the level shifting section by supplying the stationary current to the level shifting section, during a period in which the start signal is on an active level, while (ii) deactivating the level shifting section by cutting off the stationary current, during a period in which the start signal is on a non-active level.

The drive circuits for driving data signal lines and scanning signal lines, the drive circuits being formed so as to be integral with the display panel and being made of polycrystalline silicon and the like have mobility lower than the mobility of external circuits made of single-crystal silicon chips. For this reason, the drive voltage of the drive circuits is higher than the drive voltage of the external circuits, and hence it is necessary to provide a level shifter to a drive circuit to which a signal is supplied from an external circuit. Using the shift register of the present invention makes it possible to effectively reduce the amounts of power consumption in the data signal line drive circuit, the scanning signal line drive circuit, and also the display device.

In addition to the reduction of the power consumption, the change of the input signal is not reflected during the shifting operation of the shift register, i.e. during the writing operation, image reproduction is performed with no defects, even if the input signal is a signal directly contributes to the image reproduction. Furthermore, the change of the input signal is reflected to the change in the image reproduction with no time lag.

For a fuller understanding of the nature and advantages of the invention, reference should be made to the ensuing detailed description taken in conjunction with the accompanying drawings.

DESCRIPTION OF THE EMBODIMENTS

Figure 5:
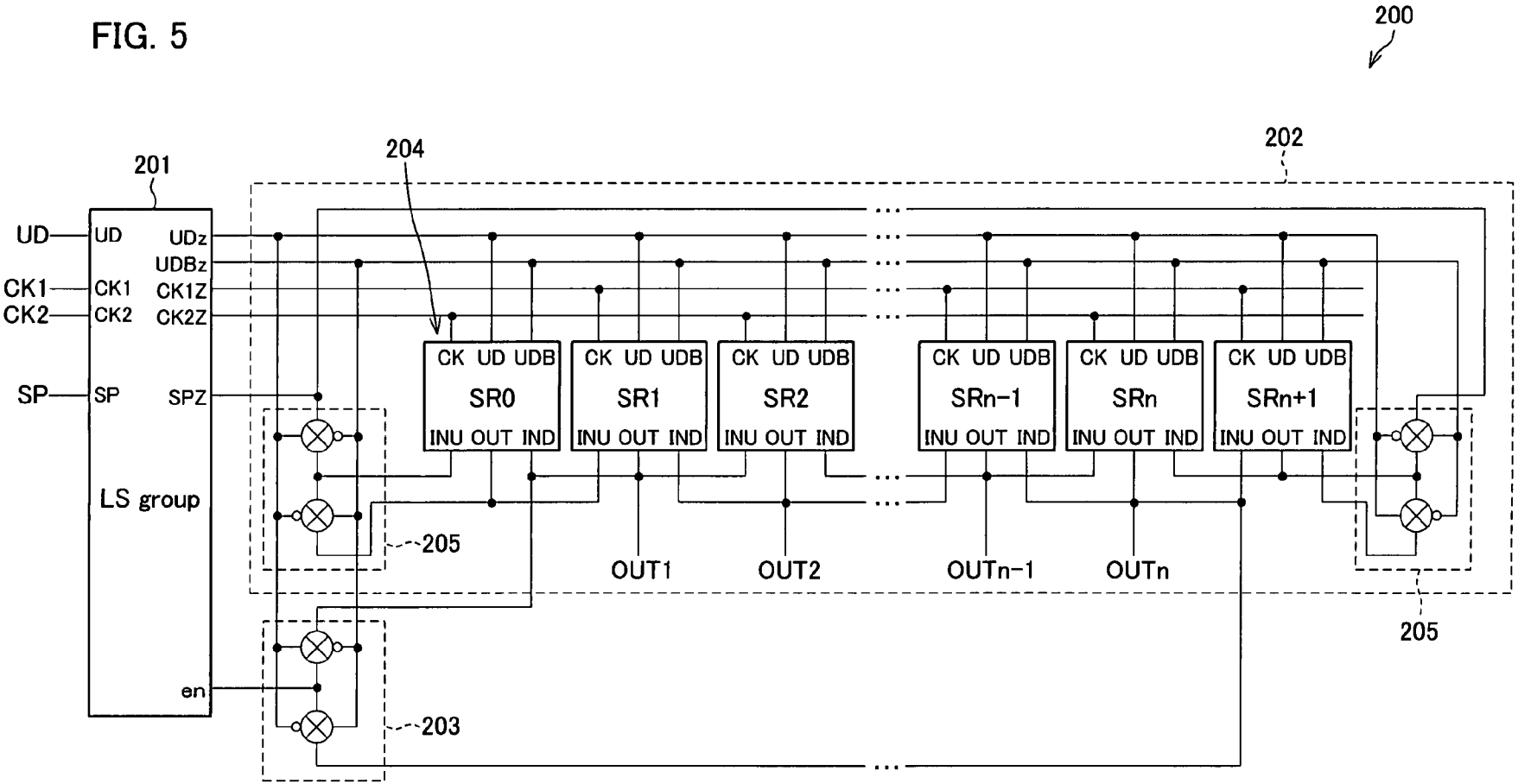
FIG. 5 is a block diagram of a scanning signal line drive circuit of a comparative example of the present invention.

First, a comparative example of the present invention will be discussed with reference to FIGS. 5–8. FIG. 5 is a block diagram of a scanning signal line drive circuit 200 of the comparative example. In this scanning signal line drive circuit, a level shifter 201*a* (cf. FIG. 7) steps up a shifting direction switching signal UD (cf. FIG. 6) for switching the shifting direction of the bi-directional shift register, and a stationary current of the level shifter 201*a* is caused to flow only during a period in which the output on the last stage of the bi-directional shift register 204 (cf. FIG. 5) is HIGH, so that the reduction of the power consumption is realized.

The scanning signal line drive circuit 200 is manufactured in a monolithic fashion and is made up of a level shifter group 201, a shift register block 202, and a last-stage output selecting circuit 203.

The level shifter group 201 is made up of level shifters for level-shifting various low-voltage input signals, which are supplied from the outside of the display device, to high-voltage signals. Examples of such input signals include a shifting direction switching signal UD for switching the shifting direction of a below-mentioned bi-directional shift register 204, first and second clock signals CK1 and CK2 which are shift clocks of the bi-directional shift register 204, and a start signal SP which starts the shifting operation of the bi-directional shift register 204. These input signals turn to an in-panel shifting direction switching signal UDz, in-panel first and second clock signals CK1Z and CK2Z, and an in-panel start signal SPZ, respectively, after passing through corresponding level shifters in the level shifter group 201.

The shift register block 202 includes: the bi-directional shift register 204 made up of (n+2)-stage flip-flops SR0, SR1, . . . , SRn, and SRn+1 which are cascaded; and start signal selecting circuits 205 provided on the respective sides of the bi-directional shift register 204. Provided that n scanning signal lines OUT1 through OUTn are provided, the outputs from the respective flip-flops SR1 through SRn of the shift register 204 drive the respective scanning signal lines OUT1 through OUTn. The outputs from the flip-flops SR0 and SRn+1 provided at the respective ends are, in accordance with the shifting direction, used for detecting the start signal SP or resetting the flip-flop of the last stage.

The last-stage output selecting circuit 203 selects the output from the bi-directional shift register 204 of the last stage of the shift register block 202 in a current shifting direction. As described above, in the scanning signal line drive circuit of the comparative example, the stationary current of the level shifter for the shifting direction switching signal UD is supplied only during a period in which the output from the bi-directional shift register 204 of the last stage is HIGH. In the bi-directional shift register 204, from which bi-directional shift register 204 the output of the last stage is supplied is determined by the shifting direction, so that it is necessary to provide a circuit for selecting the last-stage output.

Figure 6:
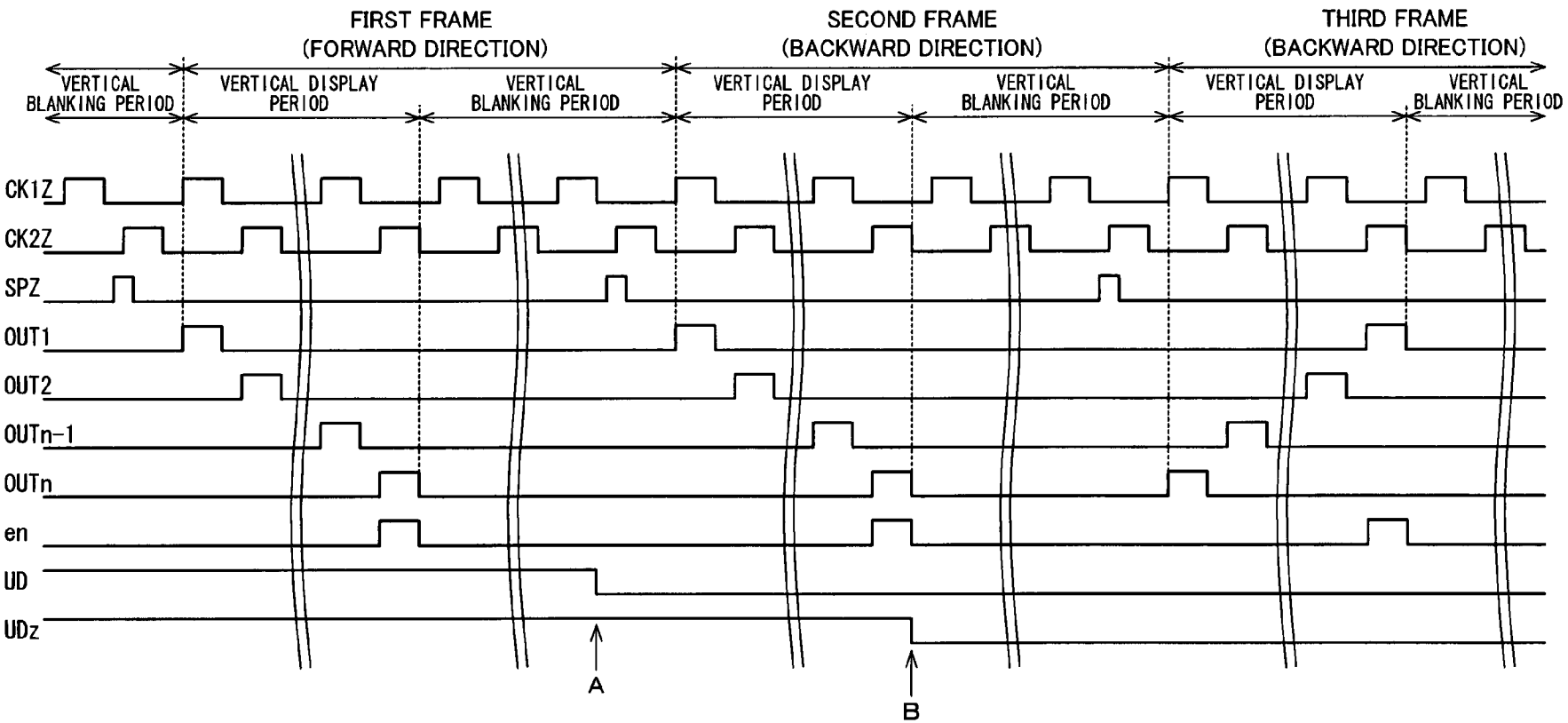
FIG. 6 is a timing chart for illustrating the operation of the scanning line drive circuit in FIG. 5.

A timing chart in FIG. 6 shows the operation of the scanning signal line drive circuit 200. As in the figure, after the start signal SP is supplied to the scanning signal line drive circuit 200 (i.e. after the start signal SP is set to HIGH active), a vertical display period starts at a clock CKZ (CK1Z in this case) which is next to the clock at which the in-panel start signal SPZ which is the start signal SP being level-shifted is detected.

In the vertical display period, provided that the shifting in the bi-directional shift register 204 is carried out in the forward direction, i.e. in the direction from the flip-flop SR0 to the flip-flop SRn+1, the outputs from the shift register block 202 serially appear at the scanning signal line OUT1 of the first stage through the scanning signal line OUTn of the last stage (i.e. these signal lines are serially set to HIGH). After the output to the scanning signal line OUTn finishes (i.e. the scanning signal line OUTn is set to LOW), a vertical blanking period starts. In the meanwhile, provided that the shifting is carried out in the backward direction, i.e. in the direction from the flip-flop SR0 to the flip-flop SRn+1, the outputs from the shift register block 202 serially appear at the scanning signal line OUTn of the first stage through the scanning signal line OUT1 of the last stage. After finishing the output to the scanning signal line OUT1, the vertical blanking period starts. A display period for one image is termed one frame, and one frame is made up of these vertical display period and vertical blanking period. The display device serially reproduces images as a sequence of frames.

As shown in FIG. 6, the scanning signal line drive circuit of the comparative example is arranged in such a manner that, while the output on the scanning signal line OUTn of the last stage of the shift register block 202 is HIGH, an enable signal en which causes the stationary current to flow in the level shifter for the shifting direction switching signal UD is set to HIGH. When the enable signal en is HIGH, the shifting direction switching signal UD can be level-shifted. At the fall of the output on the scanning signal line OUTn of the last stage, i.e. at the fall of the en signal, the signal level of the shifting direction switching signal UD being level-shifted is held, while the in-panel shifting direction switching signal falls in line with the fall of the output on the scanning signal line OUTn, i.e. in line with the fall of the en signal (at a point B in the figure). On this occasion, the fall of the signal is reflected to the in-panel shifting direction switching signal UDz.

The change of the shifting direction switching signal UD is reflected to the in-panel shifting direction switching signal UDz at the timing of the fall of the output on the line OUTn of the last stage, because switching the shifting direction switching signal UDz in the vertical display period results in the inversion of the shifting direction of the bi-directional shift register 204 in the midst of the vertical display period, thereby causing a displayed image to be disturbed. In the vertical blanking period, meanwhile, the bi-directional shift register 204 does not operate so that the change of the shifting direction switching signal UD does not influence on a displayed image.

Figure 7:
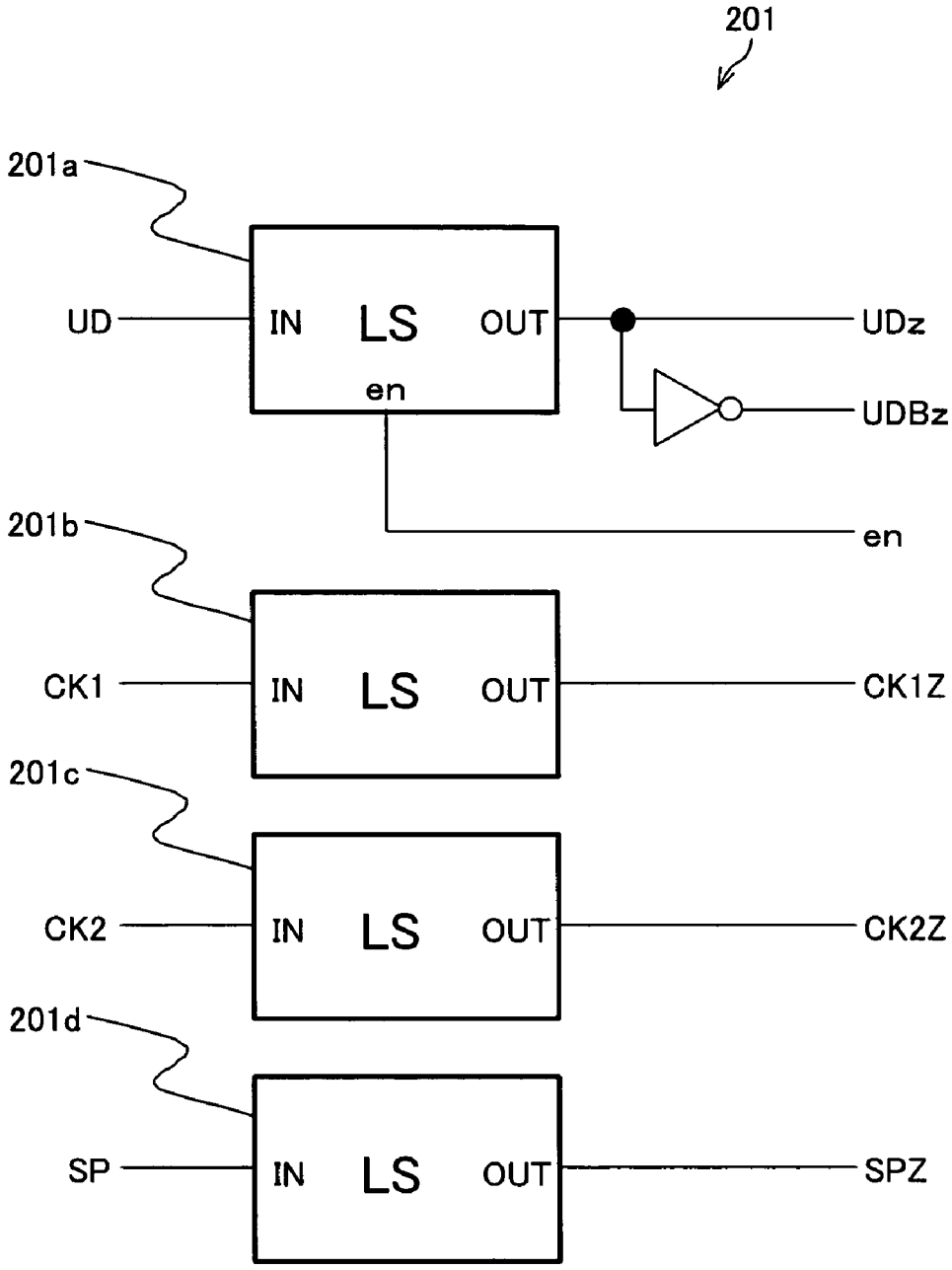
FIG. 7 is a block diagram showing circuitry of a level shifter group in the scanning signal line drive circuit in FIG. 5.

FIG. 7 shows a block diagram of the aforementioned level shifter group 201. The level shifter group 201 is made up of: a level shifter 201*d* for the start signal SP; level shifters 201*b* and 201*c* for the first and second clock signals CK1 and CK2; and a level shifter 201*a* for the shifting direction switching signal UD. Note that, "UDBz" in the figure indicates an inversion signal of the in-panel shifting direction switching signal.

Figure 8:
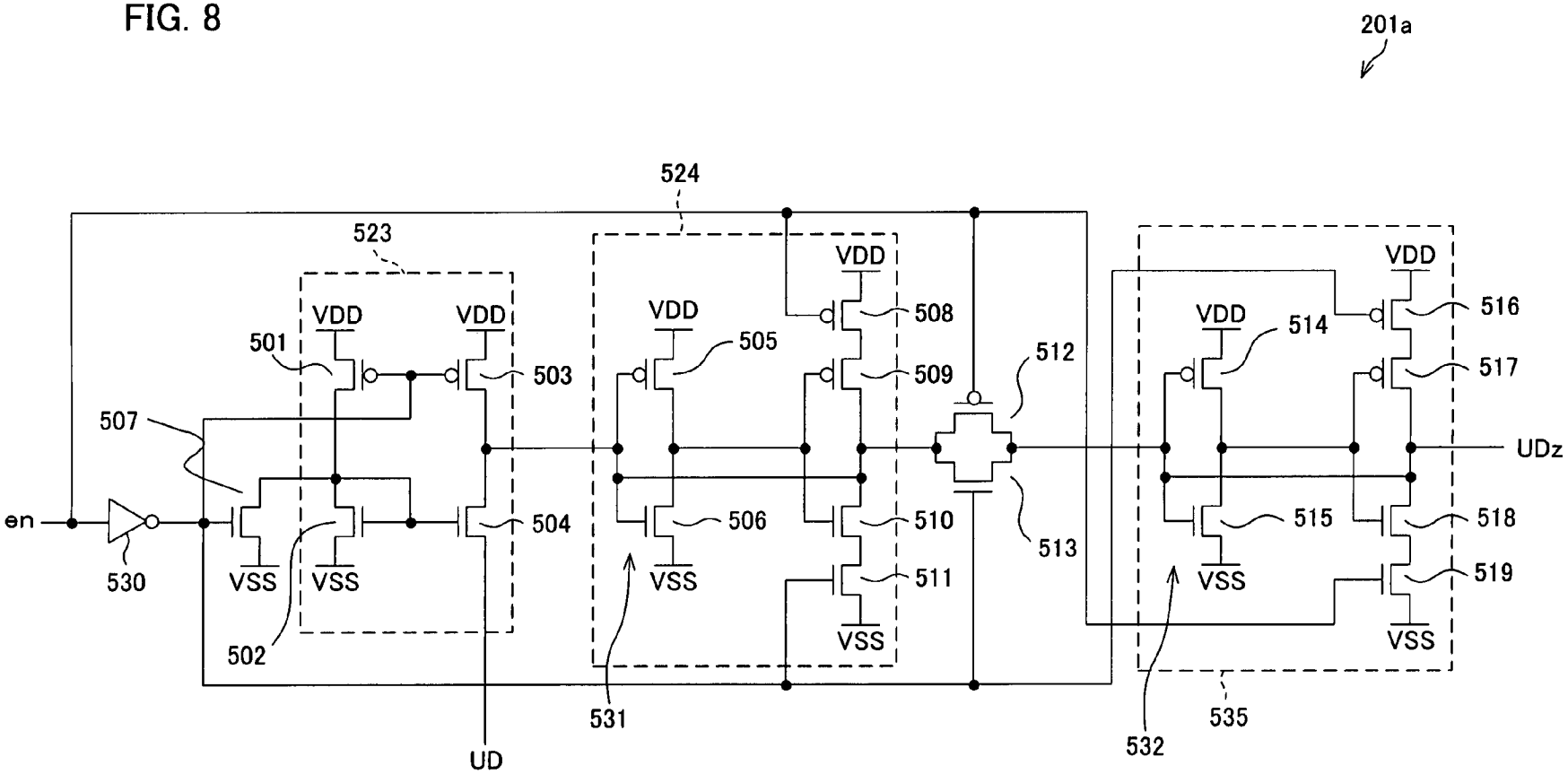
FIG. 8 is an electric circuit diagram of a comparative level shifter in the scanning signal line drive circuit of the comparative example of the present invention.

FIG. 8 illustrates circuitry of the level shifter 201*a* for the shifting direction switching signal UD. This level shifter 201*a* includes PMOS transistors 501, 503, 505, 508, 509, 512, 514, 516, and 517 and NMOS transistors 502, 504, 506, 507, 510, 511, 513, 515, 518, and 519.

Figure 11:
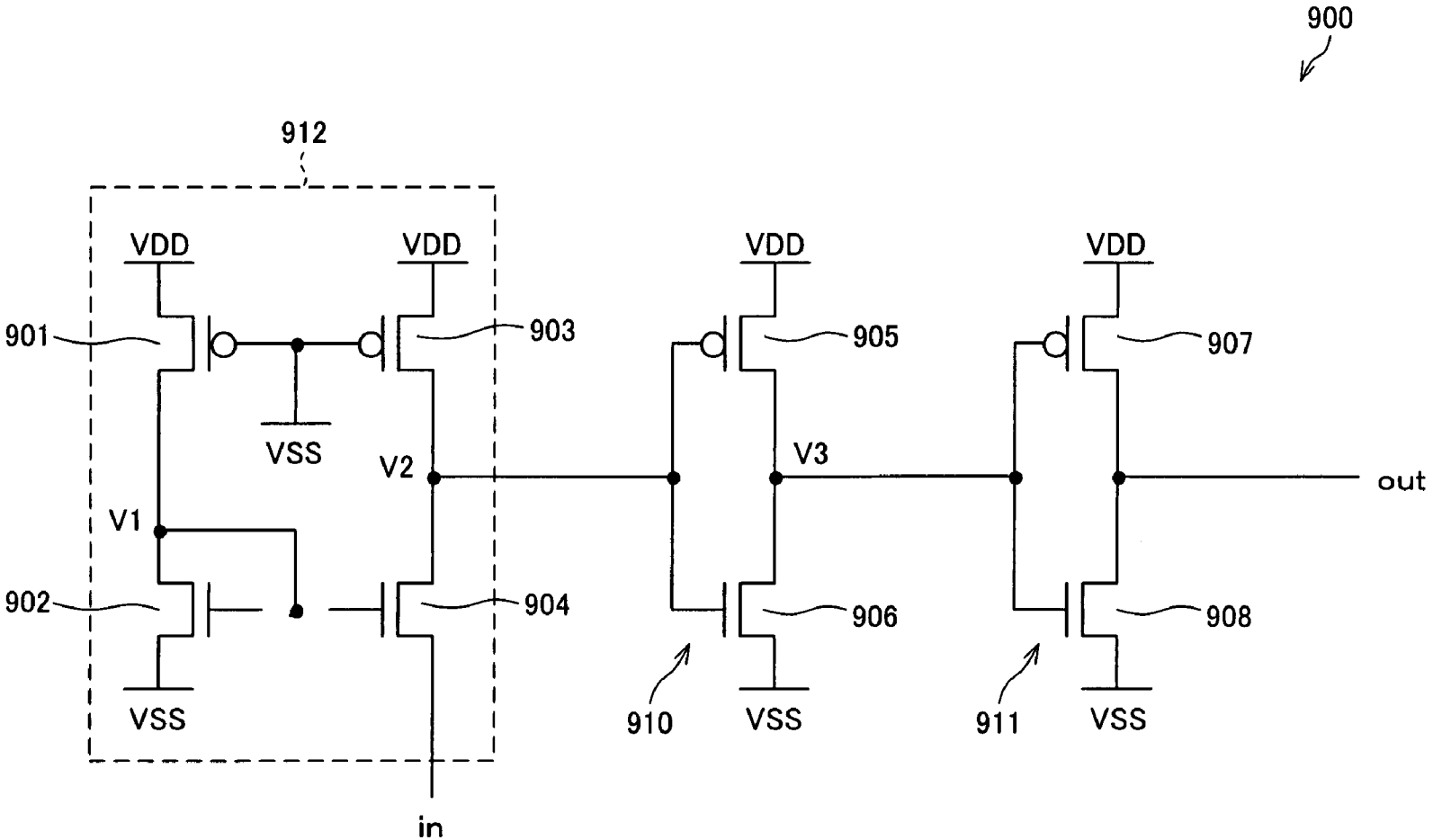
FIG. 11 is an electric circuit diagram of a typical level shifter.

The PMOS transistors 501, 503, and 505 and the NMOS transistors 502, 504, and 506 are substantially identical with the PMOS transistors 901, 903, and 905 and the NMOS transistors 902, 904, and 906 constituting the level shifter in FIG. 11. The PMOS transistors 501 and 503 and the NMOS transistors 502 and 504 constitute a level shifting section (level shifting means) 523, and the PMOS transistor 505 and the NMOS transistor 506 constitute an inverter 531. Being different from the above, in the level shifter 201*a*, the gate terminals of the PMOS transistors 501 and 503 receive an enable signal en via the inverter 530, and the junction of the drain terminal and the gate terminal of the NMOS transistor 502 is connected to the drain terminal of the NMOS transistor 507. The source terminal of the NMOS transistor 507 is connected to the VSS level, and the gate terminal of this NMOS transistor 507 receives the enable signal en via the inverter 530. A shifting direction switching signal ed appears at the source terminal of the NMOS transistor 504.

The PMOS transistor 505 and the NMOS transistor 506 constituting the inverter 531 have the drain terminals being connected to each other, and the junction of these drain terminals is connected to the gate terminals of the PMOS transistor 509 and the NMOS transistor 510. These gate terminals are connected to each other. The source terminal of the PMOS transistor 509 is connected to the drain terminal of the PMOS transistor 508 whose source terminal is at the VDD level. The gate terminal of the PMOS transistor 508 receives the enable signal en. Meanwhile, the source terminal of the NMOS transistor 510 is connected to the NMOS transistor 511 whose source terminal is connected to the VSS level, and the gate terminal of the NMOS transistor 511 receives the enable signal en via the inverter 530.

The junction of the drain terminals of the PMOS transistor 509 and the NMOS transistor 510 is connected to the junction of the source terminals of the PMOS transistor 512 and the NMOS transistor 513. These source terminals are connected to each other. The junction of the drain terminals of the PMOS transistor 509 and the NMOS transistor 510 is also connected to the gate terminals of the PMOS transistor 505 and the NMOS transistor 506 constituting the inverter 531. These gate terminals are also connected to each other. The PMOS transistors 505, 508, and 509 and the NMOS transistors 506, 510, and 511 constitute a first latch circuit 524.

The gate terminal of the PMOS transistor 512 receives the enable signal en, while the gate terminal of the NMOS transistor 513 receives the enable signal en via the inverter 530. The junction of the drain terminals of the PMOS transistor 512 and the NMOS transistor 513 is connected to the gate terminals of the PMOS transistor 514 and the NMOS transistor 515 constituting the inverter 532. The drain terminals of these PMOS transistor 514 and the NMOS transistor 515 are also connected to each other. The source terminal of the PMOS transistor 514 is at the VDD level, while the source terminal of the NMOS transistor 515 is at the VSS level. These PMOS transistors 514 and the NMOS transistor 515 constitute the inverter 532.

The junction of the drain terminals of the PMOS transistor 514 and the NMOS transistor 515 functions as an output terminal of the inverter 532, and this output terminal is connected to the gate terminals of the PMOS transistor 517 and the NMOS transistor 518. The source terminal of the PMOS transistor 517 is connected to the drain terminal of the PMOS transistor 516 whose source terminal is at the VDD level. The gate terminal of the PMOS transistor 516 receives the enable signal en via the inverter 530. Meanwhile, the source terminal of the NMOS transistor 518 is connected to the drain terminal of the NMOS transistor 519 whose source terminal is at the VSS level. The gate terminal of the NMOS transistor 519 receives the enable signal en.

The junction of the drain terminals of the PMOS transistor 517 and the NMOS transistor 518 functions as an output terminal, and from this output terminal, the in-panel shifting direction switching signal UDz is outputted. This output terminal is connected to the gate terminals of the PMOS transistor 514 and the NMOS transistor 515 constituting the inverter 532. The PMOS transistors 514, 516, and 517 and the NMOS transistors 515, 518, and 519 constitute a second latch circuit 535.

In the shift register being thus structured, when the enable signal en is HIGH (at the VDD level), the NMOS transistor 507 turns OFF and the gate terminals of the PMOS transistor 501 and the PMOS transistor 503 are set to LOW (at the VSS level). Therefore, the PMOS transistor 501, the NMOS transistor 502, the PMOS transistor 503, the NMOS transistor 504, the PMOS transistor 505, and the NMOS transistor 506 carry out the level shifting in order to change the signal level of the shifting direction switching signal UD, as in the case of the PMOS transistor 901, the NMOS transistor 902, the PMOS transistor 903, the NMOS transistor 904, the PMOS transistor 905, and the NMOS transistor 906 of the shift register in FIG. 9.

Since the PMOS transistor 508 and the NMOS transistor 511 are both turned OFF, the PMOS transistors 508 and 509 and the NMOS transistors 510 and 511 do not operate at all. Furthermore, since the PMOS transistor 512 and the NMOS transistor 513 are also both turned OFF, the signal generated by level-shifting and inverting the shifting direction switching signal UD does not influence on the circuits on the stages after the PMOS transistor 514 and the NMOS transistor 515. In the circuits on the stages after the PMOS transistor 514 and the NMOS transistor 515, the PMOS transistor 516 and the NMOS transistor 519 turn ON and constitute the second latch circuit 535. For this reason, the enable signal en holds the output UDz which has not become HIGH.

That is to say, when the enable signal en is HIGH, the level shifting section 523 operates and causes the shifting direction signal UD to level-shift. Meanwhile, the in-panel shifting direction switching signal UDz holds the signal level before the enable signal en is set to HIGH.

When, on the other hand, the enable signal en is LOW (at the VSS level), the PMOS transistors 501 and 503 turn OFF and the NMOS transistor 507 turns ON, so that the gate terminals of the NMOS transistors 502 and 504 are at the VSS level and hence the NMOS transistors 502 and 504 turn OFF. Therefore, the stationary current no longer flows in the level shifting section 523, and the level shifting section 523 does not carry out the level shifting of the shifting direction switching signal UD.

On this occasion, both the PMOS transistor 508 and the NMOS transistor 511 are in the ON state, so that the PMOS transistors 508 and 509 and the NMOS transistors 510 and 511 constitute the first latch circuit, along with the PMOS transistor 505 and the NMOS transistor 506, and hold the inversion signal of the signal which has been level-shifted before the enable signal en is set to LOW (VSS level). Since the PMOS transistor 512 and the NMOS transistor 513 are in the ON state, the signal being held is inverted by the inverter made up of the PMOS transistor 514 and the NMOS transistor 515. As a result, the in-panel shifting direction switching UDz to be outputted is a signal being level-shifted before the enable signal en is set to LOW (VSS level). On this occasion, the PMOS transistor 516 and the NMOS transistor 519 are both in the OFF state, so that the PMOS transistors 516 and 517 and the NMOS transistor 518 and 519 do not operate at all.

In other words, when the enable signal en is LOW, the level shifting section 523 does not operate, so that the in-panel shifting direction switching signal UDz holds the signal level of the signal being level-shifted before the enable signal en is set to LOW.

On this account, the level shifter 201*a* for the shifting direction switching signal UD is set to be enable only during a period in which the enable signal en is HIGH, so that the stationary current flows therein. During this period, the shifting direction switching signal UD is level-shifted, Nevertheless, this level shifting is not reflected to the in-panel shifting direction switching signal UDz until the timing at which the enable signal en falls.

However, in this comparative example in which the output from the last stage of the shift register block 202 is controlled as the enable signal en of the level shifter for the shifting direction switching signal UD, the change of the shifting direction switching signal UD in the vertical blanking period is reflected to the in-panel shifting direction switching signal UDz after the end of the following vertical display period, and the reversal of a displayed image (i.e. the change in the operation) occurs in the frame next to the frame in which the shifting direction switching signal UD is changed. In FIG. 6, the shifting direction switching signal UD is changed in the vertical blanking period of the first frame (at a point A). In the vertical display period of the second frame, this change does not cause the in-panel shifting direction switching signal UDz to change, and finally causes the change in the in-panel shifting direction switching signal UDz in the vertical blanking period of the second frame (at a point B). Therefore, the change in the shifting direction switching signal UD is reflected to a displayed image in the third frame. In this manner, in the comparative example, there is a time lag between the switching of the shifting direction and the change of a displayed image.

Which one of the output stages OUT is designated as the last stage of the shift register block 202 is changed in accordance with the switching of the shifting direction between the forward direction (from the flip-flop SR0 to the flip-flop SRn+1) and the backward direction (from the flip-flop SRn+1 to the flip-flop SR0). In the forward direction, the output stage OUTn is designated as the last stage. Meanwhile, in the backward direction, the output stage OUT1 is designated as the last stage. Therefore, the above-mentioned last-stage output selecting circuit 203 is required for determining on which output stage (i.e. the output stage OUTn or the output stage OUT1) the last-stage output from the shift register block 202 is outputted, the enable signal en which cause the stationary current to flow in the level shifter for the shifting direction switching signal UD being the last-stage output.

As a solution to the above-described problem, an embodiment of the present invention will be discussed with reference to FIGS. 1–4. By the way, members having the same functions as those described in the comparative example are given the same numbers, so that the descriptions are omitted for the sake of convenience.

Figure 2:
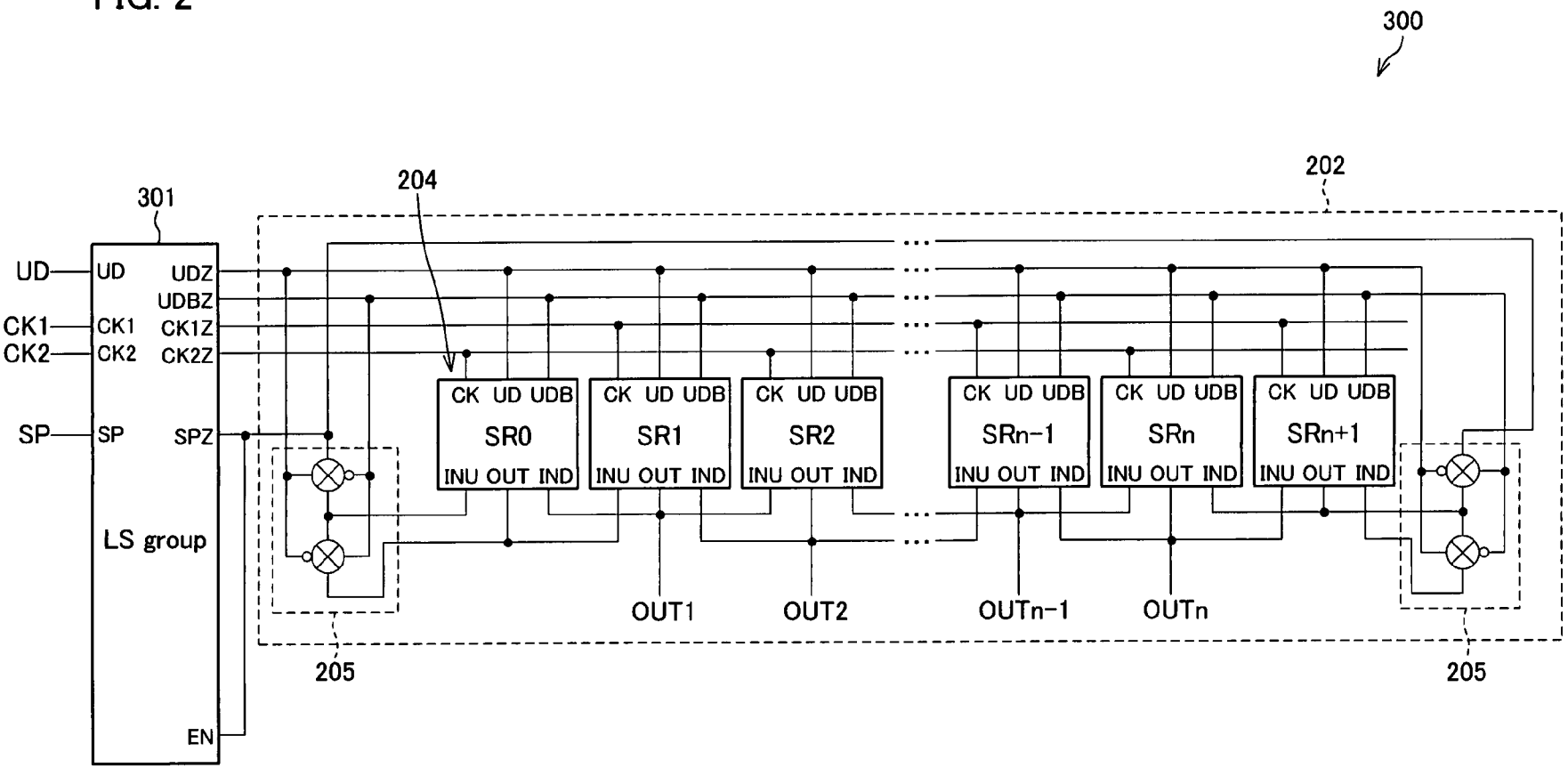
FIG. 2 is a block diagram for illustrating electric circuitry of a scanning signal line drive circuit including the level shifter in FIG. 1.
Figure 3:
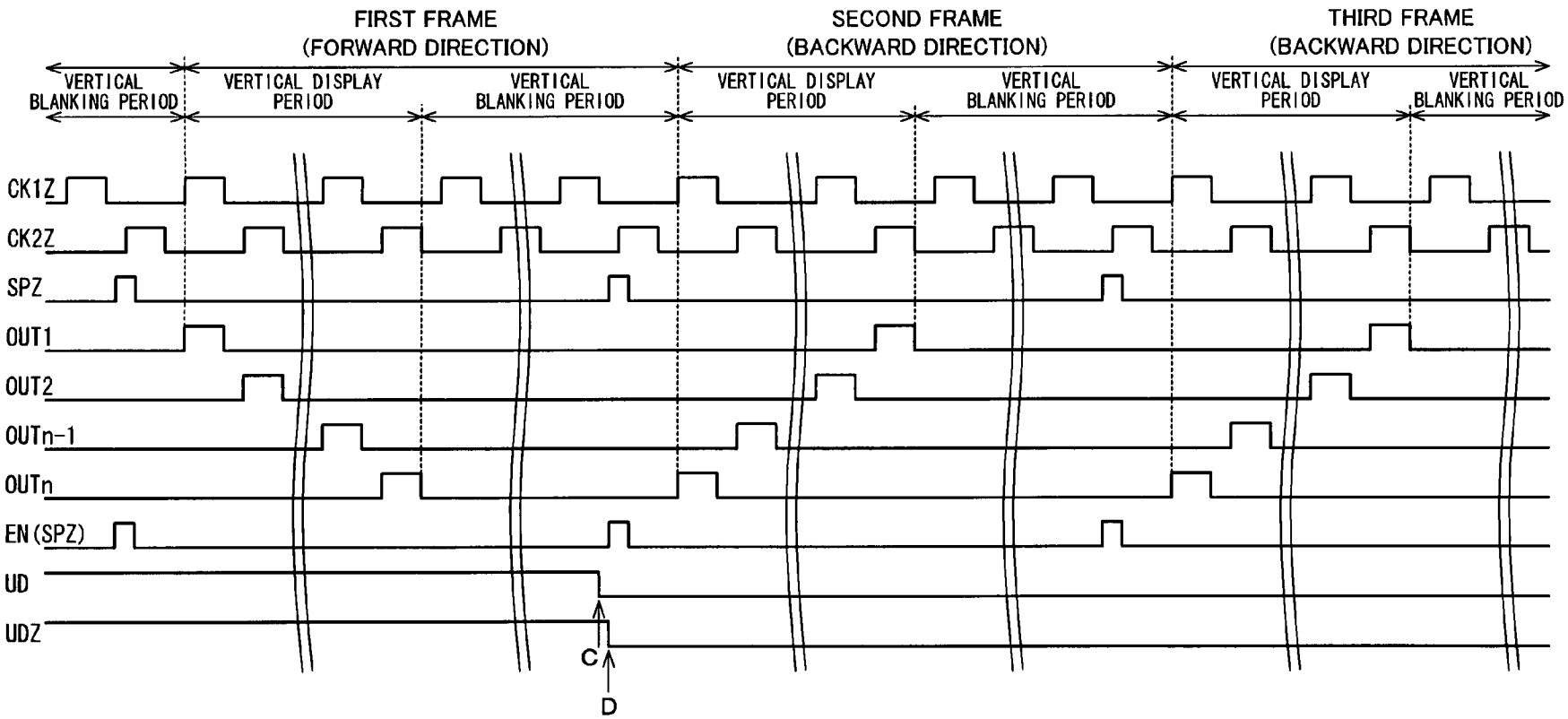
FIG. 3 is a timing chart for illustrating the operation of the scanning signal line drive circuit in FIG. 2.

FIG. 2 is a block diagram of a scanning signal line drive circuit 300 of the present embodiment. FIG. 3 is a timing chart illustrating the operation of this scanning signal line drive circuit 300.

As FIG. 2 shows, the scanning signal line drive circuit 300 is also manufactured in a monolithic fashion and includes a shift register block 202. This scanning signal line drive circuit 300 is different from the scanning signal line drive circuit of the comparative example, to the extent that a level shifter group 301 is provided in place of the level shifter group 201, and the last-stage output selecting circuit 203 is not provided.

Figure 4:
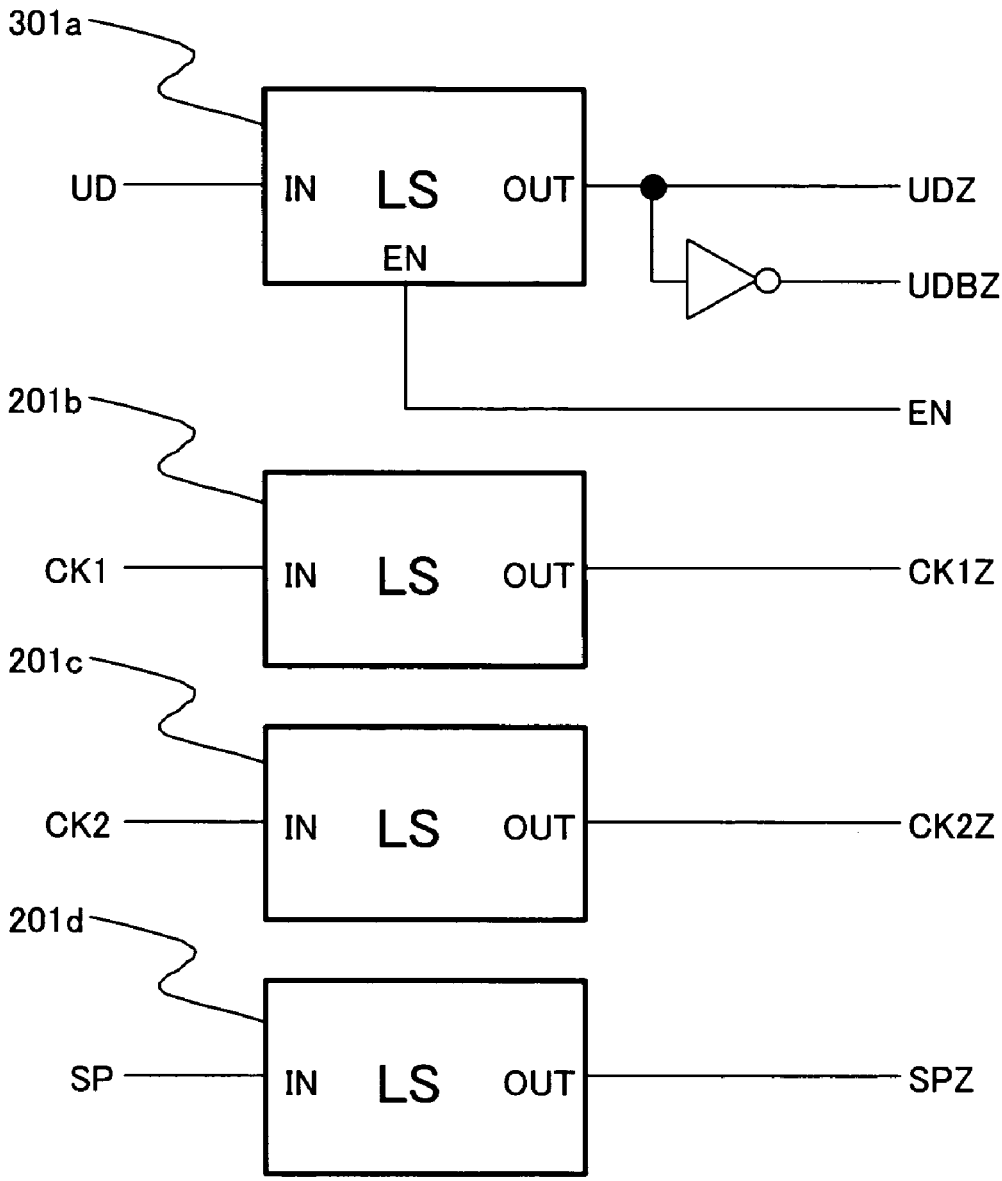
FIG. 4 is a block diagram of a level shifter group in the scanning signal line drive circuit in FIG. 2.

The level shifter group 301 includes, as the block diagram in FIG. 4 shows, a level shifter 301*a* for a shifting direction switching signal UD, in place of the level shifter 201*a* of the level shifter group 201 shown in the block diagram in FIG. 7. The level shifter 301*a* receives an enable signal EN, and using this enable signal EN, a stationary current and the operation state of the level shifter 301*a* are controlled. As shown in FIG. 2, as this enable signal EN, an in-panel start signal SPZ is adopted. This in-panel start signal SPZ is generated by level-shifting, in a level shifter 201*d*, a start signal of a bi-directional shift register.

Figure 1:
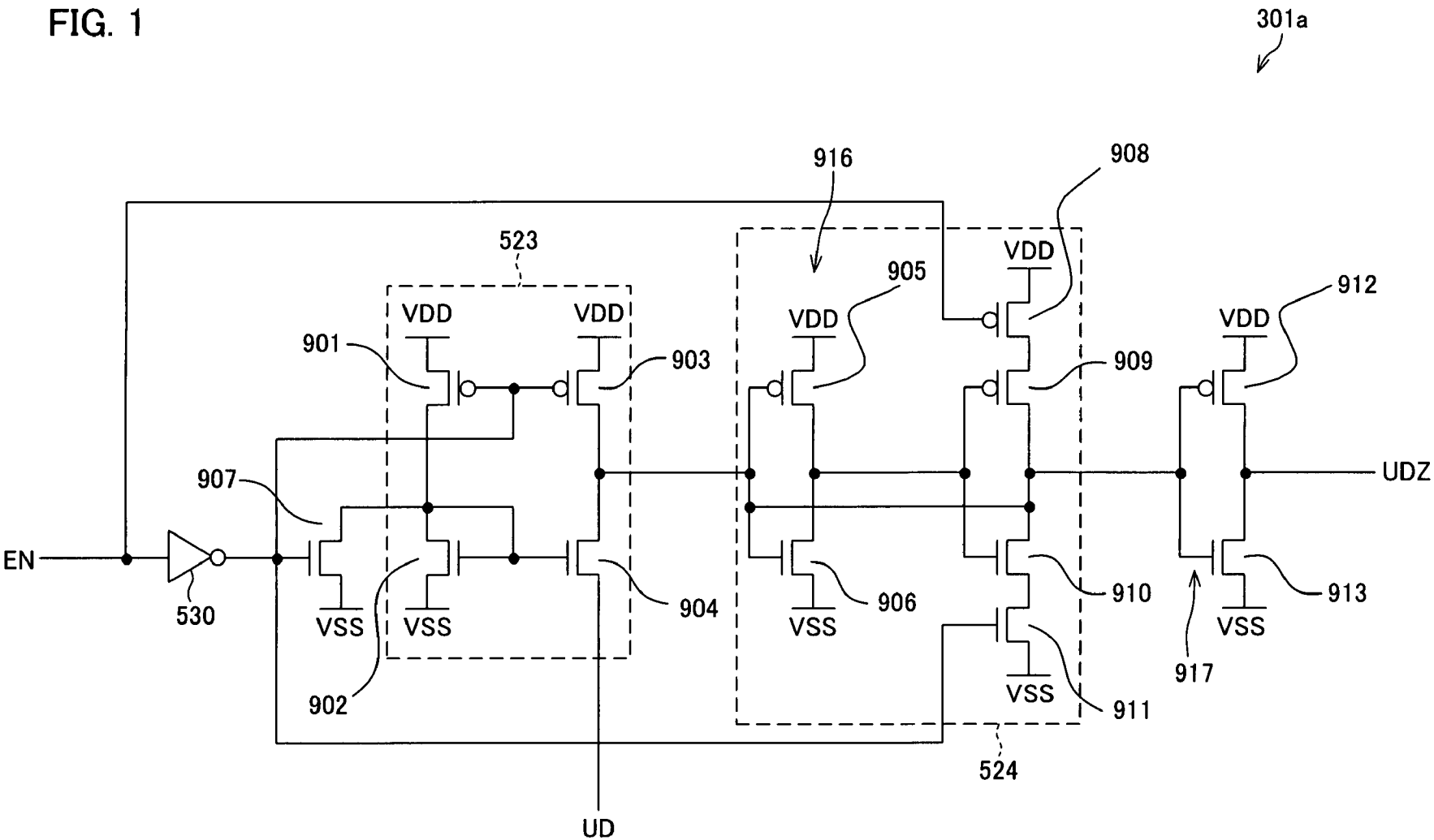
FIG. 1 relates to an embodiment of the present invention, and shows electric circuitry of a level shifter.

FIG. 1 shows a circuit diagram of the level shifter 301*a* for the shifting direction switching signal UD. The level shifter 301*a* includes PMOS transistors 901, 903, 905, 908, 909, and 912 and NMOS transistors 902, 904, 906, 907, 910, 911, and 913.

These PMOS transistors 901, 903, 905, 908, and 909 and NMOS transistors 902, 904, 906, 910, and 911 are identical in terms of structure with the PMOS transistors 501, 503, 505, 508, and 509 and NMOS transistors 502, 504, 506, 510, and 511 constituting the level shifter in FIG. 8. Therefore, in the level shifter 301*a*, the PMOS transistor 912 and the NMOS transistor 913 which are identical with the PMOS transistor 907 and the NMOS transistor 908 constituting a typical converter of the level shifter shown in FIG. 11 are provided in place of the circuit group following the PMOS transistor 512 and the NMOS transistor 513 in the level shifter 201*a*.

In the level shifter 301*a* being thus arranged, provided that the enable signal EN is HIGH (at a VDD level), i.e. the start signal SPZ is HIGH (at the VDD level), the NMOS transistor 907 receiving the enable signal EN having been inverted by the inverter 530 turns OFF, and the gate terminals of the PMOS transistors 901 and 903 receive LOW (VSS level). Since both the PMOS transistor 908 and the NMOS transistor 911 are in the OFF state, the PMOS transistors 908 and 909 and the PMOS transistors 910 and 911 do not operate at all. Therefore, the level shifter 301*a* has identical circuitry with the level shifter in FIG. 11. That is to say, when the enable signal EN is HIGH, the in-panel shifting direction switching signal UDZ is a level-shifted shifting direction switching signal UD.

In the meanwhile, provided that the enable signal EN is LOW (at a VSS level), i.e. the start signal SPZ is LOW (at the VSS level), both the PMOS transistors 901 and 903 turn OFF, the NMOS transistor 907 turns ON, and the gate terminals of the NMOS transistors 902 and 904 receive the VSS level, so that the NMOS transistors 902 and 904 also turn OFF. As a result, the stationary current no longer flows in the level shifting section 523, and the operation of the level shifting section 523 is stopped. On this occasion, both the PMOS transistor 908 and the NMOS transistor 911 are in the ON state. On this account, the PMOS transistors 908 and 909 and the NMOS transistors 910 and 911 constitute a first latch circuit 524 (signal level holding means), along with the PMOS transistor 905 and the NMOS transistor 906, and these PMOS transistors 908 and 909 and the NMOS transistors 910 and 911 hold an inversion signal of the enable signal EN having been level-shifted before being set to LOW (VSS level). The signal being held turns to a non-inverted signal in an inverter 917 made up of the PMOS transistor 912 and the NMOS transistor 913.

That is to say, when the enable signal EN is LOW, the level shifter for the shifting direction switching signal UD does not operate, and the in-panel shifting direction switching signal UDZ holds the enable signal EN having been level-shifted before being set to LOW.

On this account, the level shifter circuit 301*a* for the shifting direction switching signal UD is set to enable only during a period in which the enable signal is HIGH, i.e. the start signal SPZ is HIGH, and the stationary current flows therein. When the stationary current flows, the shifting direction switching signal UD is level-shifted, and this level-shifted signal is reflected to the in-panel shifting direction switching signal UDZ. The level-shifted signal is held even after the enable signal EN is set to LOW, i.e. the start signal SPZ is set to LOW. According to FIG. 3, if the signal UD is changed in the vertical blanking period of the first frame (at a point C), the in-panel shifting direction switching signal UDZ is changed at a point D, so that the signal UDZ has already been changed before the vertical display period of the second frame. In this manner, no time lag occurs. Note that, the operation control means in this case is made up of the inverter 530, the PMOS transistors 908 and 909, the NMOS transistors 907, 910, and 911, and the like.

As described above, in the scanning signal line drive circuit 300 of the present embodiment, the stationary current flows in the level shifting section 523 only when the start signal SP is HIGH (active), while the stationary current is cut off when the start signal SP is LOW (non-active). With this, the power consumption is reduced compared to the arrangement in which the stationary current always flows.

Furthermore, the level shifting section 523 of the level shifter 301*a* is activated only during a period in which the start signal SP of the bi-directional shift register 204 is HIGH. For this reason, the timing at which the shifting direction switching signal UD is level-shifted in the level shifting section 523 does not overlap the shift operation period of the bi-directional shift register 402. Therefore, even if the shifting direction switching signal UD is changed in the middle of the shifting operation of the bi-directional shift register 204, this signal is level-shifted and causes the shifting direction to switch, always during a period in which the shifting operation of the bi-directional shift register 204 is stopped (i.e. during the vertical blanking period). On this account, the switching of the shift direction caused by the change of the shifting direction switching signal UD does not occur in the middle of the shifting operation of the bi-directional shift register 204, which influences on a displayed image.

Furthermore, the switching of the shifting direction occurs in the shifting operation period of the bi-directional shift register 204 immediately after the change of the shifting direction switching signal UD. Therefore, when the shifting direction switching signal UD is switched, the operation follows the switching with no time lag.

When being deactivated, the level shifter 301*a* holds the level of the signal which has been level-shifted and is immediately before cutting off the stationary current flowing in the first latch circuit 524. On this account, during a period in which the level shifting section 523 is deactivated and the operation of the level shifter 301*a* is stopped, the output voltage of the level shifter 301*a* does not become inconsistent, so that the operation of a circuit in a stage following the level shifter 301*a* is not caused to be inconsistent.

Note that, although the present embodiment exemplifies the scanning signal line drive circuit, the following arrangement is also feasible as a matter of course: the level shifter 301*a* for the shifting direction switching signal is included in a data signal line drive circuit. Also, although the descriptions above premise the level shifter 301*a* for the shifting direction switching signal which does not frequently change, the present invention is not limited to this type of level shifter. For instance, it is possible to adopt a level shifter for a signal whose frequency is lower than that of the start signal of the shift register 204. Examples of the signal whose frequency is lower than that of the start signal include a resolution switching signal and a signal for switching between a binary driver and an analogue driver. Adopting such a shift register also makes it possible to obtain effects similar to those of the present embodiment.

Figure 9:
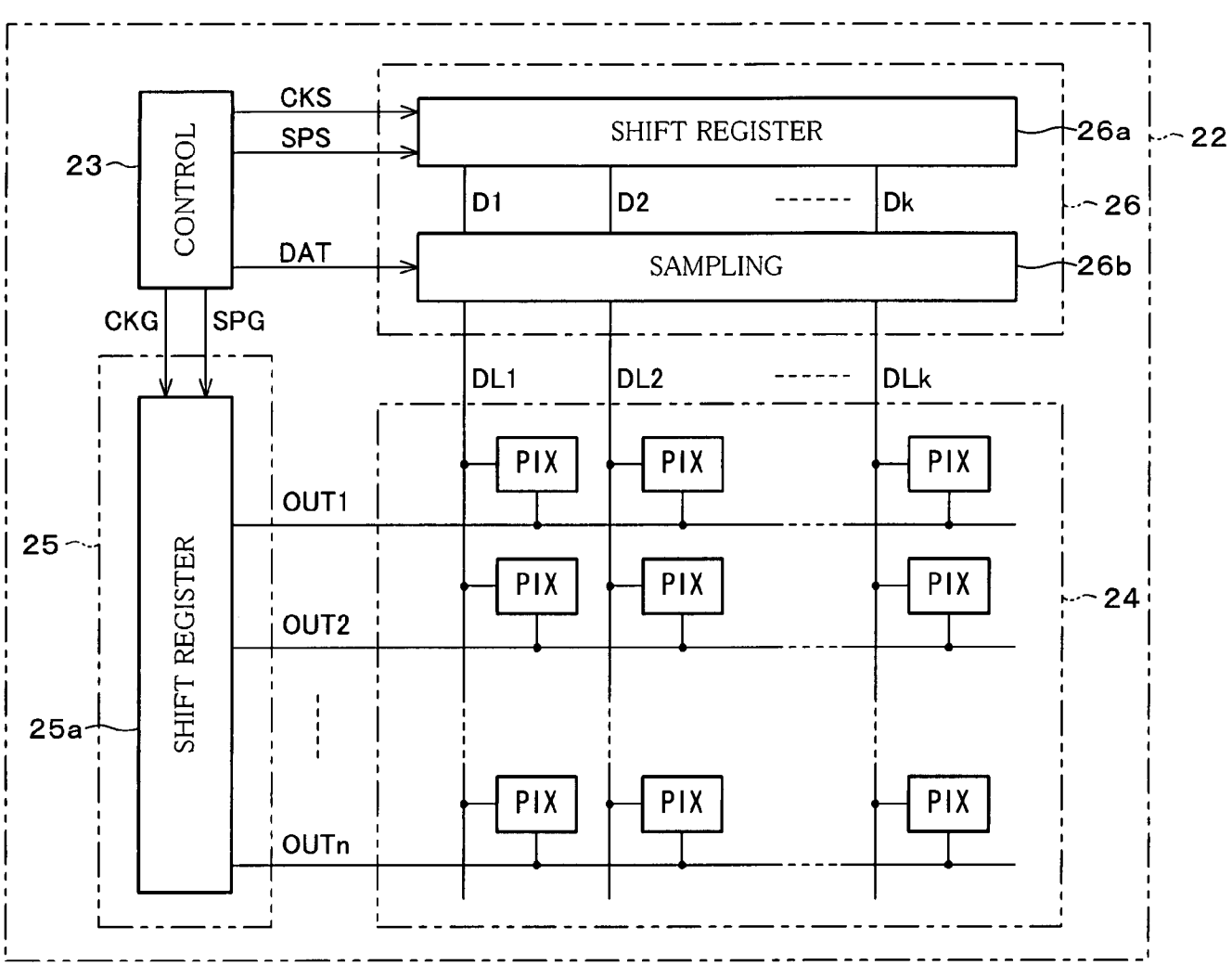
FIG. 9 is a block diagram of an example of an image display device adopting the shift register of the present invention.

Finally, the following discusses an image display device provided with the scanning signal line drive circuit and the data signal line drive circuit including the above-described level shifter 301*a*, as a preferable example illustrating how the level shifter 301*a* is used. FIG. 9 is a block diagram of the image display device 21.

Roughly speaking, the image display device 21 is arranged such that a control circuit 23 for generating a video signal DAT is mounted on a display panel 22. The display panel 22 is made up of a display section 24 including pixels PIX disposed in a matrix manner, a scanning signal line drive circuit 25, and a data signal line drive circuit 26, these drive circuits being provided for driving the pixels PIX. The scanning signal line drive circuit 25 includes a shift register 25*a*, while a data signal line drive circuit 26 includes a shift register 26*a* and a sampling circuit 26*b*. At least one of these shift registers 25*a* and 26*a* includes a shift register equivalent in terms of circuitry with the above-described level shifter 301*a*.

In order to simplify the manufacturing process and reduce the line capacity, the display section 24 and the drive circuits 25 and 26 are monolithically formed on one substrate. Also, in order to integrate a great number of pixels PIX and enlarge the display area, the display section 24 and the drive circuits 25 and 26 are made up of polycrystalline silicon thin-film transistors and the like formed on a glass substrate. These polycrystalline silicon thin-film transistors are manufactured at a process temperature of not more than 600° C. With this, when a typical glass substrate whose strain point is not more than 600° C. is adopted, it is possible to avoid the warpage and deflection of the substrate.

Image reproduction is performed on the display section 24, in the following manner: n scanning signal lines OUT1 through OUTn and k data signal lines DL1 through DLk intersect with each other so as to form areas in each of which the pixel PIX is provided. To these areas, the scanning signal line drive circuit 25 and the data signal line drive circuit 26 serially write a video signal DAT supplied from the control circuit 23, via the scanning signal lines OUT1 through OUTn and the data signal lines DL1 through DLk. The pixel PIX is, for instance, structured as shown in FIG. 10.

Figure 10:
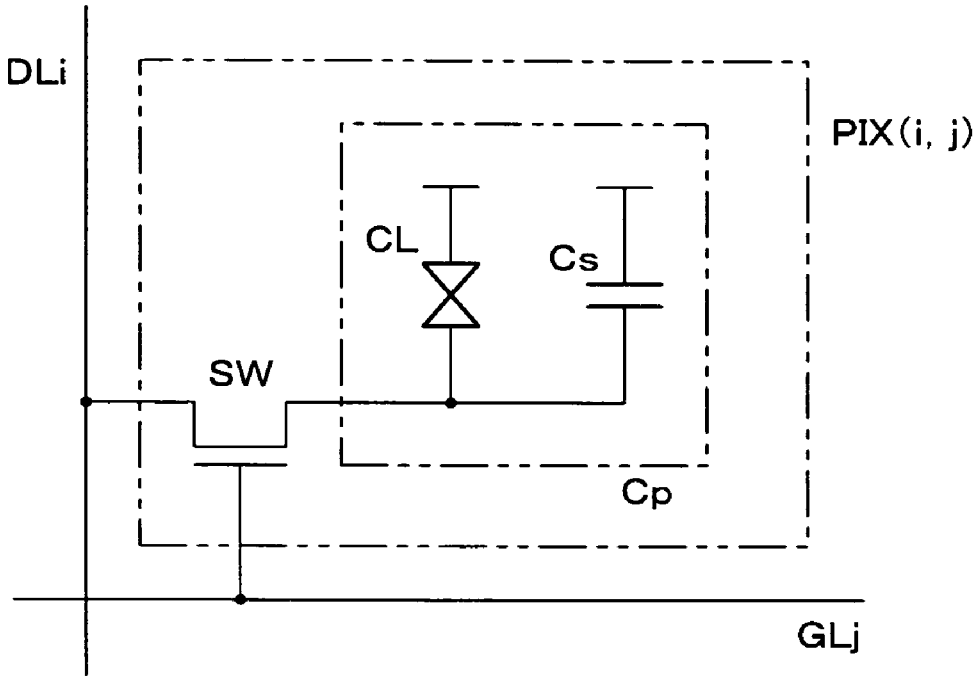
FIG. 10 is an equivalent circuit diagram of a pixel of the image display device in FIG. 9.

In FIG. 10, an arbitrary integral number i which indicates an address and is not more than k and an arbitrary integral number j which is not more than n are added not only to the scanning signal line OUT and the data signal line DL but also to the pixel PIX. The pixel PIX includes: a field effect transistor (switching element) SW whose gate is connected to the scanning signal line Out and whose source is connected to the data signal line DL; and a pixel capacity Cp one of whose electrodes is connected to the drain of the field effect transistor SW. The other one of the electrodes of the pixel capacity Cp is connected to a common electrode line which is common to all of the pixels PIX. The pixel capacity Cp is made up of a liquid crystal capacity CL and an auxiliary capacity Cs which is added as the need arises.

Therefore, when the scanning signal line OUT is selected, the field effect transistor SW turns ON, so that a voltage on the data signal line DL is supplied to the pixel capacity Cp. Meanwhile, during a period in which the scanning signal line OUT is not selected and the field effect transistor SW is in the OFF state, the pixel capacity CP holds the voltage before the transistor SW is turned off. The transmittance or reflectance of liquid crystal changes in accordance with the voltage applied to the liquid crystal capacity CL. For this reason, the lighting state of the pixel PIX can be changed in accordance with the video signal DAT, by selecting the scanning signal line OUT and supplying, to the data signal line DL, a voltage corresponding to the video signal DAT.

From the control circuit 23 to the data signal line drive circuit 26, the video signal DAT is supplied to the respective pixels PIX in a time-division manner. At timings corresponding to (i) clock signals CK1Z and CK2Z which are to be timing signals and have predetermined intervals and (ii) a start signal SPZ, the data signal line drive circuit 26 samples video data from the video signal DAT, and supplies the sampled video data to the pixels PIX. More specifically, the shift register 26*a* serially shifts the start pulse SPS, in sync with the clock signal CKS supplied from the control circuit 23. As a result, output signals D1 through Dk having timings different from each other at specified time intervals are generated. At the timings indicated by these output signals D1 through Dk, the sampling circuit 26*b* samples the video signal DAT, and supply the sampled signal to the data signal lines DL1 through DLk.

In a similar manner, In the scanning signal line drive circuit 25, the shift register 25*a* serially shifts the start signal SPG (SP), in sync with the clock signal CKG (CK1 and CK2) supplied from the control circuit 23. As a result, scanning signals having timings different from each other at specified time intervals are supplied to the respective scanning signal lines OUT1 through OUTn.

As described above, in the image display device 21, the display section 24 and the drive circuits 25 and 26 formed on the display panel 22 are made up of polycrystalline silicon thin-film transistors and the like, and the drive voltage Vcc for driving these members are, for instance, about 15V. Meanwhile, the control circuit 23 which is an IC chip is made up of single-crystal silicon transistors, and the drive voltage of the same is 5V or less, i.e. this drive voltage is lower than the above-mentioned drive voltage Vcc.

Although, in this manner, the display section 24 and the drive circuits 25 and 26 are formed on the substrate different from the substrate on which the control circuit 23 is formed, the number of signals exchanged between the members on the different substrates are significantly fewer than the number of signals exchanged between the display section 24 and the drive circuits 25 and 26. More specifically, the signals exchanged between the members on the different substrates are no more than the video signal DAT, the start signals SPS and SPG, and the clock signals CKS and CKG. Furthermore, the control circuit 23 is made of single-crystal silicon transistors, and hence can easily secure sufficient driving force. On this account, even if the above-described members are formed on different substrates, the increase of the manufacturing steps, line capacities, and power consumption are restrained to be negligible.

In this manner, the drive circuits 25 and 26 monolithically formed on the display panel 22 are made of polycrystalline silicon and the like, and the level shifter 13 which is required because the drive voltage is higher than that of external circuits is activated only during a period in which the start signal SP is supplied. With this, a display panel consuming fewer amounts of power is realized.

The level shifter of the present invention is combined with a shift register and includes level shifting means in which a stationary current flows, the level shifting means for causing a signal level of an input signal to level-shift, a frequency of the input signal being lower than a frequency of a start signal for starting the shift register, the level shifter comprising: operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

According to this arrangement, thanks to the operation of the operation control means, the stationary current flows in the level shifting means only during the period in which the start signal is on the active level, while the stationary current is cut off during the period in which the start signal is on the non-active level. On this account, the power consumption is reduced compared to the arrangement in which the stationary current always flows.

Moreover, since the level shifting means is activated only in the period in which the start signal of the shift register is on the active level, the timing at which the input signal is level-shifted in the level shifting means does not overlap the shifting operation period of the shift register. For this reason, even if the input signal is changed in the midst of the shifting operation of the shift register, the level-shifting of the input signal and the change of the operation (reflection of the signal change to the operation) always occur during a period in which the shifting operation of the shift register is not performed. For this reason, it is unnecessary to take any measures to prevent the operation change due to the change of the input signal from being performed during a period in which the shifting operation of the shift register is performed.

Furthermore, the operation change due to the change of the input signal occurs in the next shifting operation period of the shift register, after the period in which the change of the input signal occurs. For this reason, when the input signal changes, it is possible to cause the operation to follow the change with no time lag.

In addition to the above, the level shifter of the present invention may further comprise signal level holding means for holding, on an occasion of deactivating the level shifting means, a signal level being level-shifted, the signal level being immediately before cutting off the stationary current.

During a period in which the level shifting means is deactivated and the level shifter is stopped, the operation of a circuit in a stage after the level shifter may become inconsistent if the output voltage form the level shifter is inconsistent.

The arrangement above provides, however, the signal level holding means for holding, on an occasion of deactivating the level shifting means, a signal level being level-shifted, the signal level being immediately before cutting off the stationary current. With this, the signal level holding means can hold the level-shifted output voltage of the level shifter, so that the malfunction of the above-mentioned circuit in a stage after the level shifter, which is caused by the inconsistent output voltage, can be prevented.

In addition to the above, the level shifter of the present invention may be arranged in such a manner that the shift register is a bi-directional shift register, and the input signal is a shifting direction switching signal for switching a shifting direction of the bi-directional shift register.

The level shifter is used for the shifting direction switching signal by which the shifting direction of the bi-directional shift register. For this reason, in addition to the reduction of the power consumption, it is possible to avoid such a problem that the shifting direction switching signal is supplied in the midst of the shifting operation of the bi-directional shift register, without providing a latch circuit, a delay circuit, and the like for preventing the level-shifted shifting direction switching signal from being supplied to the bi-directional shift register performing the shifting operation.

Moreover, the change of the shifting direction switching signal is reflected to the next shifting operation of the shift register and the shifting direction is thus switched. On this account, there is no time lag between the instruction to switch the shifting direction and the timing at which the shifting direction is actually switched.

A display device of the present invention includes: a scanning signal line drive circuit provided with a shift register; and a data signal line drive circuit provided with a shift register, an image being displayed on the display device in such a manner that, into display sections circumscribed by scanning signal lines and data signal lines intersected with each other, the scanning signal line drive circuit and the data signal line drive circuit write a video signal by driving the scanning signal lines and the data signal lines, at least one of the scanning signal line drive circuit and the data signal line drive circuit including the above-mentioned level shifter of the present invention.

The drive circuits formed so as to be integral with the display panel and being made of polycrystalline silicon and the like have mobility lower than the mobility of external circuits made of single-crystal silicon chips. For this reason, the drive voltage of the drive circuits is higher than the drive voltage of the external circuits, and hence it is necessary to provide a level shifter to a drive circuit to which a signal is supplied from an external circuit. Using the shift register of the present invention makes it possible to effectively reduce the amounts of power consumption in the data signal line drive circuit, the scanning signal line drive circuit, and also the display device.

In addition to the reduction of the power consumption, the change of the input signal is not reflected during the shifting operation of the shift register, i.e. during the writing operation, image reproduction is performed with no defects, even if the input signal is a signal directly contributes to the image reproduction. Furthermore, the change of the input signal is reflected to the change in the image reproduction with no time lag.

Another display device of the present invention including: a scanning signal line drive circuit provided with a shift register; and a data signal line drive circuit provided with a shift register, an image being displayed on the display device in such a manner that, into display sections circumscribed by scanning signal lines and data signal lines intersected with each other, the scanning signal line drive circuit and the data signal line drive circuit write a video signal by driving the scanning signal lines and the data signal lines, at least one of the scanning signal line drive circuit and the data signal line drive circuit including the above-mentioned level shifter of the present invention, as a level shifter for a shifting direction switching signal by which a shifting direction of a bi-directional shift register is switched.

Being similar to the above, the drive circuits formed so as to be integral with the display panel and being made of polycrystalline silicon and the like have mobility lower than the mobility of external circuits made of single-crystal silicon chips. For this reason, the drive voltage of the drive circuits is higher than the drive voltage of the external circuits, and hence it is necessary to provide a level shifter to a drive circuit to which a signal is supplied from an external circuit. Using the shift register of the present invention makes it possible to effectively reduce the amounts of power consumption in the data signal line drive circuit, the scanning signal line drive circuit, and also the display device.

In addition to the reduction of the power consumption, the change of the input signal is not reflected during the shifting operation of the shift register, i.e. during the writing operation, image reproduction is performed with no defects, even if the input signal is a signal directly contributes to the image reproduction. Furthermore, the change of the input signal is reflected to the change in the image reproduction with no time lag.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A level shifter which is combined with a shift register and includes level shifting means in which a stationary current flows, the level shifting means causing a signal level of an input signal to level-shift, a frequency of the input signal being lower than a frequency of a start signal for starting the shift register, the level shifter comprising:

operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

2. The level shifter as defined in claim 1, further comprising signal level holding means for holding, on an occasion of deactivating the level shifting means, a signal level being level-shifted, the signal level being immediately before cutting off the stationary current.

3. The level shifter as defined in claim 2, wherein, the shift register is a bi-directional shift register, and the input signal is a shifting direction switching signal for switching a shifting direction of the bi-directional shift register.

4. A level shifter which is combined with a shift register and includes a level shifting section in which a stationary current flows, the level shifting section causing a signal level of an input signal to level-shift, a frequency of the input signal being lower than a frequency of a start signal for starting the shift register, the level shifter comprising:

an operation control section for, by means of the start signal, (i) activating the level shifting section by supplying the stationary current to the level shifting section, during a period in which the start signal is on an active level, while (ii) deactivating the level shifting section by cutting off the stationary current, during a period in which the start signal is on a non-active level.

5. The level shifter as defined in claim 4, further comprising a signal level holding section for holding, on an occasion of deactivating the level shifting section, a signal level being level-shifted, the signal level being immediately before cutting off the stationary current.

6. A scanning signal line drive circuit which includes a shift register and drives scanning signal lines, comprising a level shifter including level shifting means in which a stationary current flows, the level shifting means causing a signal level of an input signal to level-shift, the level shifter being provided on an input of the shift register, a frequency of the input signal being lower than a frequency of a start signal for starting the shift register, and the level shifter including operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

7. A data signal line drive circuit which includes a shift register and drives data signal lines, comprising a level shifter including level shifting means in which a stationary current flows, the level shifting means causing a signal level of an input signal to level-shift, the level shifter being provided on an input of the shift register, a frequency of the input signal being lower than a frequency of a start signal for starting the shift register, and the level shifter including operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

8. A display device, including:

a scanning signal line drive circuit provided with a shift register; and a data signal line drive circuit provided with a shift register, an image being displayed on the display device in such a manner that, into display sections circumscribed by scanning signal lines and data signal lines intersected with each other, the scanning signal line drive circuit and the data signal line drive circuit write a video signal by driving the scanning signal lines and the data signal lines, at least one of the scanning signal line drive circuit and the data signal line drive circuit including a level shifter which is combined with the shift register and includes level shifting means in which a stationary current flows, the level shifting means causing a signal level of an input signal to level-shift, a frequency of the input signal being lower than a frequency of a start signal for starting the shift register, the level shifter including:

operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

9. A display device, including:

a scanning signal line drive circuit provided with a shift register; and a data signal line drive circuit provided with a shift register, an image being displayed on the display device in such a manner that, into display sections circumscribed by scanning signal lines and data signal lines intersected with each other, the scanning signal line drive circuit and the data signal line drive circuit write a video signal by driving the scanning signal lines and the data signal lines, at least one of the scanning signal line drive circuit and the data signal line drive circuit including a level shifter for a shifting direction switching signal by which a shifting direction of a bi-directional shift register is switched, the shift register being combined with a shift register and including level shifting means in which a stationary current flows, the level shifting means causing a signal level of an input signal to level-shift, a frequency of the input signal being lower than a frequency of a start signal for starting the shift register, the level shifter including:

operation control means for, by means of the start signal, (i) activating the level shifting means by supplying the stationary current to the level shifting means, during a period in which the start signal is on an active level, while (ii) deactivating the level shifting means by cutting off the stationary current, during a period in which the start signal is on a non-active level.

* * * * *